US008689140B2

(12) United States Patent
Horiuchi et al.

(10) Patent No.: US 8,689,140 B2
(45) Date of Patent: Apr. 1, 2014

(54) REMOTE CONTROL UNIT OF AIR CONDITIONING APPARATUS HAVING A MENU WITH ITEMS DISPLAYED IN A PREDETERMINED ORDER AND A TOP ITEM IN THE MENU BEING DIFFERENT WHEN A PREDETERMINED INPUT IS RECEIVED

(75) Inventors: Kaya Horiuchi, Sakai (JP); Hisashi Sumida, Sakai (JP); Yukihiro Takagaki, Sakai (JP); Ikuo Takahashi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 832 days.

(21) Appl. No.: 12/525,697

(22) PCT Filed: Feb. 13, 2008

(86) PCT No.: PCT/JP2008/052294
§ 371 (c)(1),
(2), (4) Date: Aug. 4, 2009

(87) PCT Pub. No.: WO2008/099825
PCT Pub. Date: Aug. 21, 2008

(65) Prior Publication Data

US 2010/0107019 A1 Apr. 29, 2010

(30) Foreign Application Priority Data

Feb. 13, 2007 (JP) ..... 2007-032731

(51) Int. Cl.
*G06F 3/048* (2013.01)

(52) U.S. Cl.
USPC ..... 715/810; 715/771; 236/94

(58) Field of Classification Search
None
See application file for complete search history.

(56) References Cited

U.S. PATENT DOCUMENTS

| | | | | |
|---|---|---|---|---|
| 2005/0119794 | A1* | 6/2005 | Amundson et al. | 700/276 |
| 2006/0026972 | A1* | 2/2006 | Masui et al. | 62/127 |
| 2007/0012052 | A1* | 1/2007 | Butler et al. | 62/181 |
| 2007/0050732 | A1* | 3/2007 | Chapman et al. | 715/810 |
| 2008/0009325 | A1* | 1/2008 | Zinn et al. | 455/566 |
| 2008/0048046 | A1* | 2/2008 | Wagner et al. | 236/91 R |

FOREIGN PATENT DOCUMENTS

| | | | |
|---|---|---|---|
| JP | 61-197435 | U | 12/1986 |
| JP | 06-026692 | A | 2/1994 |
| JP | 2002-022250 | A | 1/2002 |
| JP | 2003-035449 | A | 2/2003 |
| JP | 2004-125279 | A | 4/2004 |
| JP | 2006-029687 | A | 2/2006 |

OTHER PUBLICATIONS

Office Action of corresponding Japanese Application No. 2007-032731 dated Oct. 25, 2011.

* cited by examiner

*Primary Examiner* — Stephen Hong
*Assistant Examiner* — Asher Kells
(74) *Attorney, Agent, or Firm* — Global IP Counselors

(57) ABSTRACT

A remote control unit of an air conditioning apparatus includes a display unit, a cursor-moving member, a confirmation member, and a controller. The display unit displays a menu and a cursor that indicates an item among a plurality of items inside the menu and is moved by the cursor-moving member when operated by a user. The confirmation member is configured to decide that the item is to be executed. The controller controls the display unit in response to the cursor-moving member or confirmation member being operated. The controller positions an item corresponding to a predetermined input at the top of the menu upon receiving the predetermined input.

7 Claims, 5 Drawing Sheets

REMOTE CONTROL UNIT OF AIR CONDITIONING APPARATUS HAVING A MENU WITH ITEMS DISPLAYED IN A PREDETERMINED ORDER AND A TOP ITEM IN THE MENU BEING DIFFERENT WHEN A PREDETERMINED INPUT IS RECEIVED

CROSS-REFERENCE TO RELATED APPLICATIONS

This U.S. National stage application claims priority under 35 U.S.C. §119(a) to Japanese Patent Application No. 2007-032731, filed in Japan on Feb. 13, 2007, the entire contents of which are hereby incorporated herein by reference.

TECHNICAL FIELD

The present invention relates to a remote control unit for remotely operating an air conditioning apparatus.

BACKGROUND ART

An air conditioning apparatus is provided with a single remote control unit composed of a plurality of change switches, setting switches, selector switches, and a liquid-crystal display panel for displaying control specifics established by these switches (see Japanese Laid-open Patent Application No. 6-26692). With the remote control unit disclosed in Japanese Laid-open Patent Application No. 6-26692, it is standard to have one switch for each function. Therefore, there is a tendency to add switches if functions are added, and a problem with greater complexity is encountered when the number of switches increases. A remote control unit comprising a menu selection confirm switch is disclosed as a technique for resolving this problem (Japanese Laid-open Patent Application No. 2002-22250). In the remote control unit disclosed in Japanese Laid-open Patent Application No. 2002-22250, a selector switch and a cursor button are placed on the menu selection confirm switch, a dot matrix display configuration is used in the liquid crystal display panel, the display specifics are not fixed as in conventional practice, and the display method can be set freely and easily varied. It is also possible to select the required function with the cursor button and the selection confirm switch while looking at the menu screen.

SUMMARY OF THE INVENTION

Technical Problem

In the remote control unit according to Japanese Laid-open Patent Application No. 2002-22250, the number of switches is reduced and the complexity issue is resolved, yet the actual operation is not facilitated. Since functions are easily added, the number thereof tends to increase and the remote control unit can become more complicated to use.

An object of the present invention is to provide a remote control unit of an air conditioning apparatus which has excellent operability and is easily handled by a user.

Solution to Problem

A remote control unit according to a first aspect of the present invention is a remote control unit for remotely operating an air conditioning apparatus, comprising a display unit, cursor-moving means (cursor-moving button or member), confirmation means (confirmation button or member), and a controller. The display unit displays a menu and a cursor for indicating an arbitrary item inside the menu. The cursor-moving means moves the cursor. The confirmation means is used to decide that the item indicated by the cursor is to be executed. The controller controls object including the display unit to be controlled in response to the cursor-moving means or the confirmation means. Upon receiving a predetermined input, the controller positions an item corresponding to the predetermined input at the top of the menu.

With this remote control unit, the item which the user is attempting to select is given priority in the display. Therefore, the procedure of searching for the needed item is eliminated, operability is improved, and the unit is easier to use.

A remote control unit according to a second aspect of the present invention is the remote control unit according to the first aspect of the present invention, wherein the controller positions at the top of the menu a fault response item showing the locations of a plurality of information relevant to the fault needed by the user when the predetermined input is either a fault notification signal input notifying of a fault from the air conditioning apparatus or a filter maintenance request signal input requesting that the filter of the air conditioning apparatus be cleaned.

With this remote control unit, since the user can immediately obtain necessary information relevant to faults, the user can quickly deal with faults.

A remote control unit according to a third aspect of the present invention is the remote control unit according to the second aspect of the present invention, wherein the relevant information includes at least fault specifics, contact information for when a fault occurs, and the model name of the air conditioning apparatus in which the fault occurred.

With this remote control unit, the remote control unit is easier to use because the user can find the contact information, model name, and other information without looking at the owner's manual.

A remote control unit according to a fourth aspect of the present invention is the remote control unit according to the second aspect of the present invention, wherein the controller puts the display unit in standby in a standard screen for displaying only preset items different from the menu, displays a message on the standard screen in the case of either a fault notification signal input or a filter maintenance request signal input, and changes the standard screen to a menu screen that displays a menu in cases in which the confirmation means has been operated once after the message has been displayed.

With this remote control unit, since the message warns the user, it is unlikely that inconvenient events and the like will go unattended. Operability is also improved because the user can see items pertaining to the message merely by operating the confirmation means once.

A remote control unit according to a fifth aspect of the present invention is the remote control unit according to the fourth aspect of the present invention, wherein the controller positions at the top of the menu a cancel command for canceling the display of the message together with the fault response item when the predetermined input is the filter maintenance request signal input.

With this remote control unit, usability is improved because in cases in which the user understands the specifics of the message and concludes that there is no need for the display, the user can release the display of the message.

A remote control unit according to a sixth aspect of the present invention is the remote control unit according to the first aspect of the present invention, wherein the controller reads a pre-stored specific item and positions the item at the top of the menu when the predetermined input is a prolonged time signal input for maintaining the same signal for a specified time duration.

With this remote control unit, items common to all users can be included on the menu from the beginning, and specific items needed for a specific user can be included on the menu afterward. As a result, the items in the menu are put in order, and a menu which is easy to use can be created for the user.

A remote control unit according to a seventh aspect of the present invention is the remote control unit according to the sixth aspect of the present invention, wherein the prolonged time signal input is outputted when one operation of the confirmation means is maintained for a specified time duration.

With this remote control unit, the input operation is simple.

Advantageous Effects of the Invention

With the remote control unit according to the first aspect of the present invention, the item which the user is attempting to select is given priority in the display. Therefore, the procedure of searching for the needed item is eliminated, operability is improved, and the unit is easier to use.

With the remote control unit according to the second aspect of the present invention, since the user can immediately obtain needed information relevant to faults, the user can quickly deal with faults.

With the remote control unit according to the third aspect of the present invention, the remote control unit is easier to use because the user can find the contact information, model name, and other information without looking at the owner's manual.

With the remote control unit according to the fourth aspect of the present invention, since the message warns the user, it is unlikely that inconvenient events and the like will go unattended. Operability is also improved because the user can see items pertaining to the message merely by operating the confirmation means once.

With the remote control unit according to the fifth aspect of the present invention, usability is improved because in cases in which the user understands the specifics of the message and concludes that there is no need for the display, the user can release the display of the message.

With the remote control unit according to the sixth aspect of the present invention, items common to all users can be included on the menu from the beginning, and specific items needed for a specific user can be included on the menu afterward. As a result, the items in the menu are put in order, and a menu which is easy to use can be created for the user.

With the remote control unit according to the seventh aspect of the present invention, the input operation is simple.

DETAILED DESCRIPTION OF THE INVENTION

An embodiment of the present invention is described hereinbelow with reference to the drawings. The following embodiment is a specific example of the present invention and is not intended to limit the technological scope of the invention.

(General Configuration of Air Conditioning Apparatus)

Figure 1:
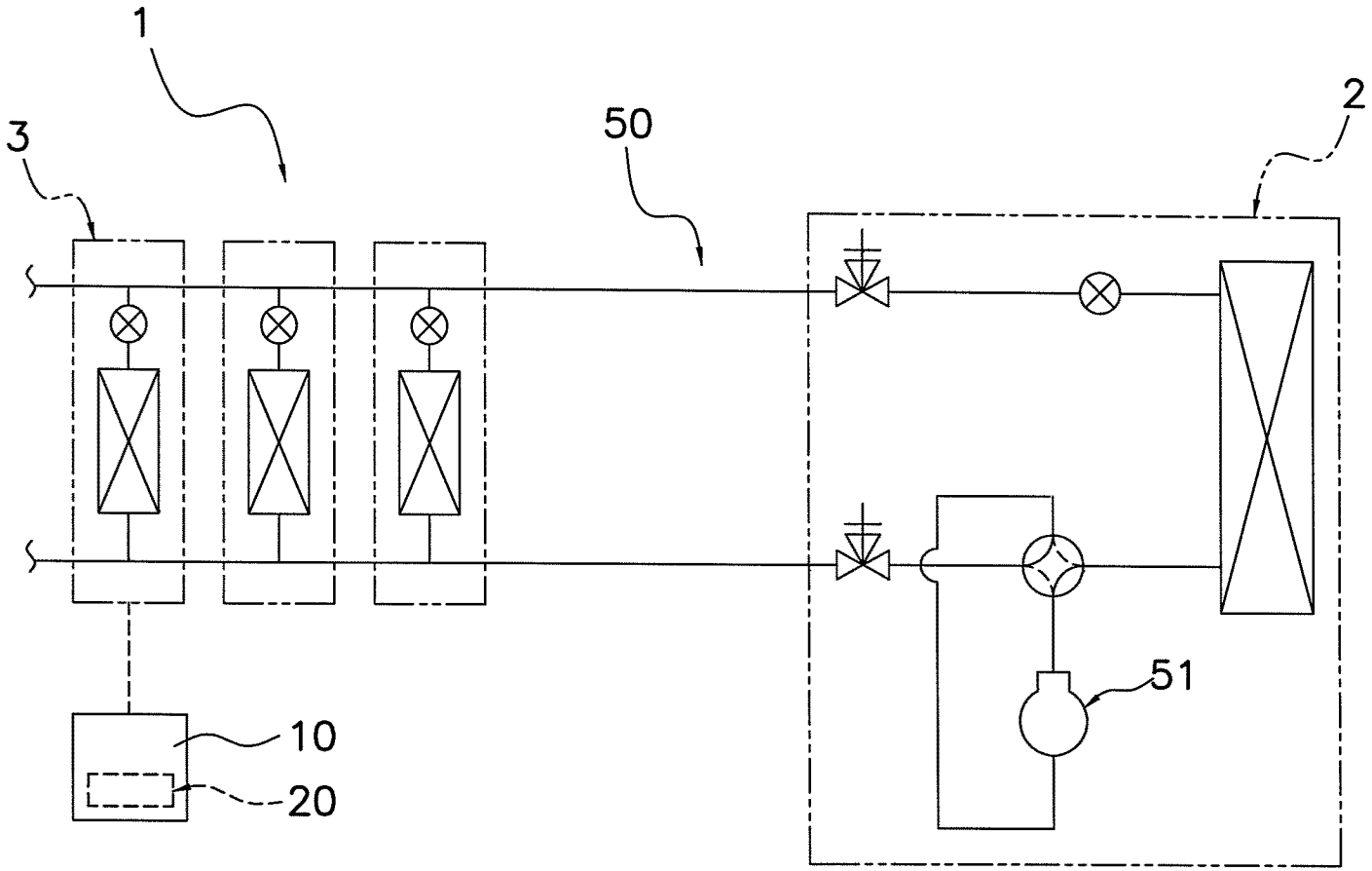
FIG. 1 is a schematic structural drawing of an air conditioning apparatus including a remote control unit according to an embodiment of the present invention.

FIG. 1 is a schematic structural drawing of an air conditioning apparatus including a remote control unit according to an embodiment of the present invention. An air conditioning apparatus 1 is a multi-type air conditioning apparatus for a building, wherein a plurality of indoor units 3 are connected in parallel with one or more outdoor units 2, and a refrigerant circuit 50 including a compressor 51 is formed so that refrigerant can flow through. A remote control unit 10 communicates with control devices (not shown) installed in both the outdoor unit 2 and the indoor units 3 in accordance with operations made by the user so as to control the air conditioning apparatus 1.

(Remote Control Unit)

Figure 2A:
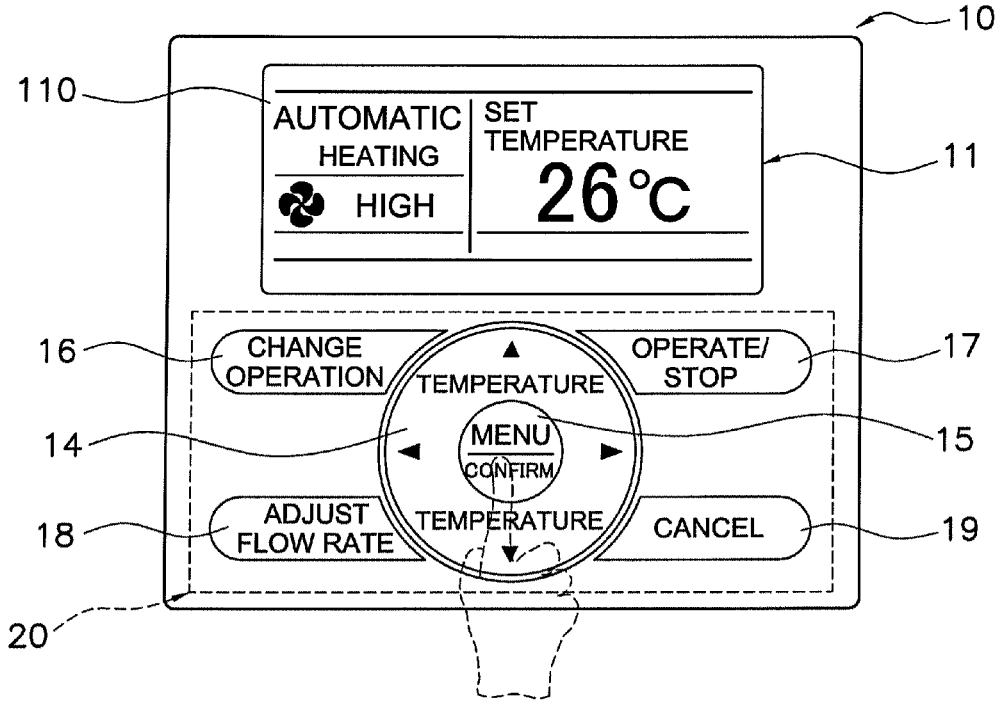
FIG. 2(*a*) is a front view showing standby mode of the remote control unit, and FIG. 2(*b*) is a front view of the remote control unit displaying a menu screen.
Figure 2B:
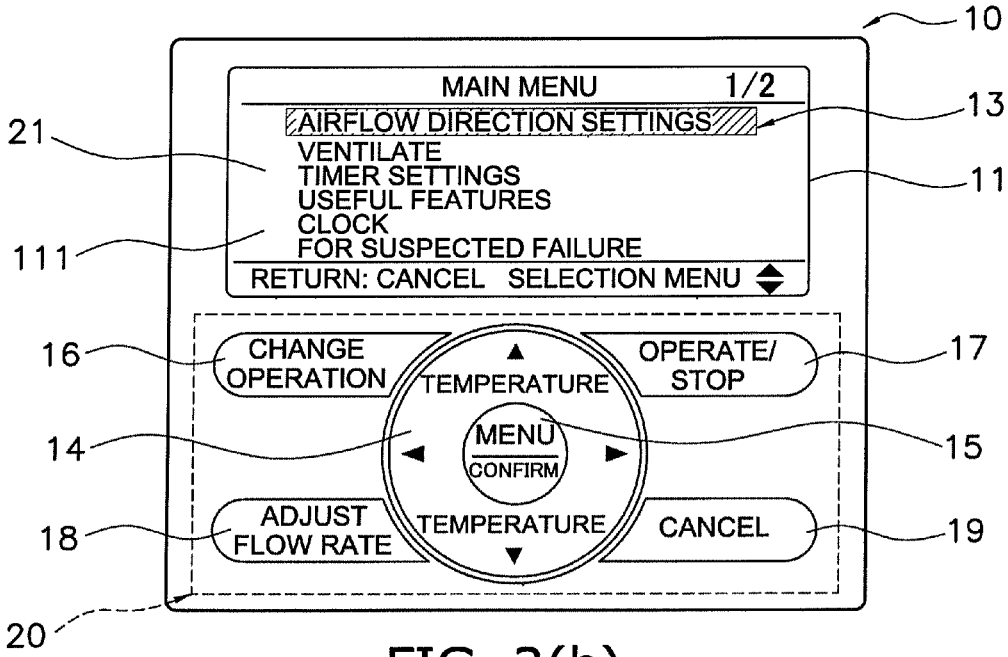

FIG. 2(*a*) is a front view showing standby mode of a remote control unit according to an embodiment of the present invention. In FIG. 2(*a*), the remote control unit 10 comprises a display unit 11, a cursor-moving button (cursor-moving member) 14, a confirm button (confirmation member) 15, a change operation button 16, an operate/stop button 17, an adjust flow rate button 18, a cancel button 19, and a controller 20.

The display unit 11 uses a full dot liquid crystal display, and can appropriately change displays between a standard screen 110 during standby mode, a menu screen 111 for displaying a menu 21, and the like. The cursor-moving button 14 is a button operated when moving a cursor 13 for indicating arbitrary items on the menu 21. The cursor-moving button 14 displays four marks showing the directions up, down, left, and right, and pressing a mark causes the cursor 13 to move in the direction corresponding to the mark.

The confirm button 15 is a button operated when deciding on an item on the menu 21 indicated by the cursor 13. The words "menu/confirm" are printed on the confirm button 15, and when the confirm button 15 is pressed, the menu 21 is displayed. When an item is selected from the menu 21 and the confirm button 15 is pressed again, the item is executed. Furthermore, the confirm button 15 is used not only to decide on items, but also to execute other controls. The time duration T for which the confirm button 15 is pressed is 1 second or less when deciding on an item, and 3 seconds or more when executing another control; however, the time duration T is not limited.

The change operation button 16 is a button operated when changing the operating mode of the air conditioning apparatus 1. Each time the change operation button 16 is pressed, the operating mode changes sequentially to blowing air, drying, automatic cooling, automatic heating, cooling, heating, air purification/ventilation, ventilation, and air purification. The operating mode while the apparatus is active is displayed at the top left of the standard screen 110 when viewed from the front. The operate/stop button 17 is a button operated when starting or stopping the operation of the air conditioning apparatus 1, and the operate/stop button 17 repeats starting and stopping each time it is pressed.

The adjust flow rate button 18 is a button operated when adjusting the amount of air discharged from the indoor units 3. Each time the adjust flow rate button 18 is pressed, the flow rate changes sequentially between low, high, and rapid. The cancel button 19 is a button operated when cancelling out the specifics set with the confirm button 15 or another button.

The controller 20 has a microcomputer (not shown) and a memory (not shown). The controller 20 reacts to the operations of the cursor-moving button 14, the confirm button 15, the change operation button 16, the operate/stop button 17, the adjust flow rate button 18, and the cancel button 19, and communicates with the display unit 11, the control device (not shown) of the outdoor unit 2, and the control devices (not shown) of the indoor units 3 so as to set the air conditioning apparatus 1 to the appropriate operating state. The controller 20 is located inside the remote control unit 10 and therefore cannot be seen from the outside.

The controller 20 keeps the display unit 11 in standby in the standard screen 110 when the controller 20 has not received any input. In the standard screen 110, the operating mode is displayed in the top left section, the flow rate is displayed in the bottom left section, and the set temperature is displayed in the right section, as shown in FIG. 2(*a*). When varying the set temperature, pressing the top of the cursor-moving button 14 raises the numeral, and pressing the bottom of the cursor-moving button 14 lowers the numeral.

When the display unit 11 is in standby in the standard screen 110, pressing the confirm button 15 once changes to a menu screen displaying the menu 21. FIG. 2(*b*) is a front view of the remote control unit displaying a menu screen. In FIG. 2(*b*), the menu 21 includes an "airflow direction setting" item for setting the direction of discharged air, a "timer setting" item for setting the operation starting time or operation stopping time, and other items.

When the user selects an item from the menu 21, the cursor 13 is moved to the desired item with the cursor-moving button 14, and pressing the confirm button 15 once while the item is indicated by the cursor 13 causes specifics pertaining to the item to be displayed.

(Message Display when a Fault Occurs)

Figure 3A:
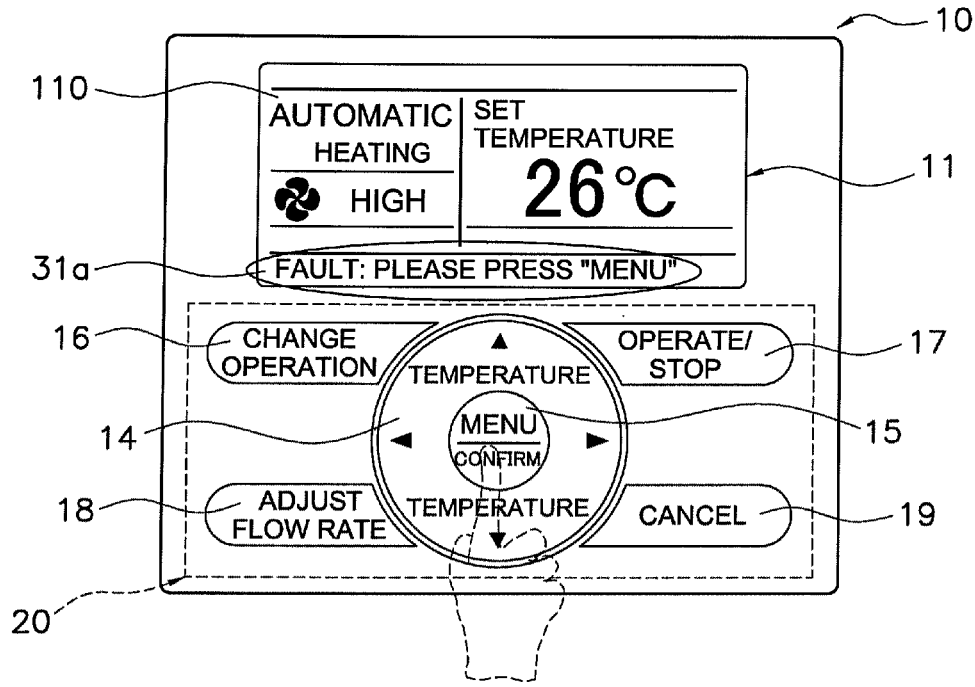
FIG. 3(*a*) is a front view of the remote control unit displaying a message, FIG. 3(*b*) is a front view of the menu screen after the notification of a fault message, and FIG. 3(*c*) is a front view of a fault response screen.
Figure 3B:
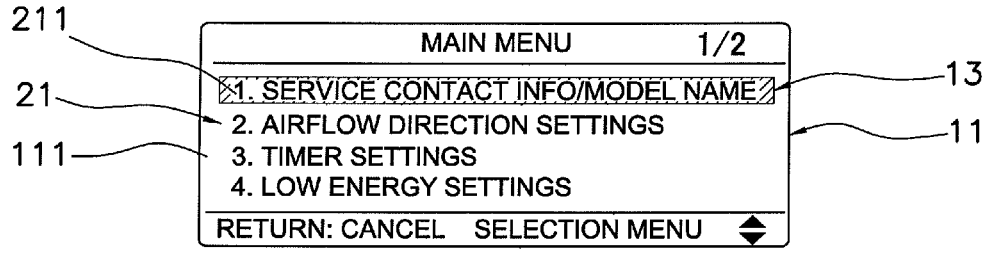
Figure 3C:
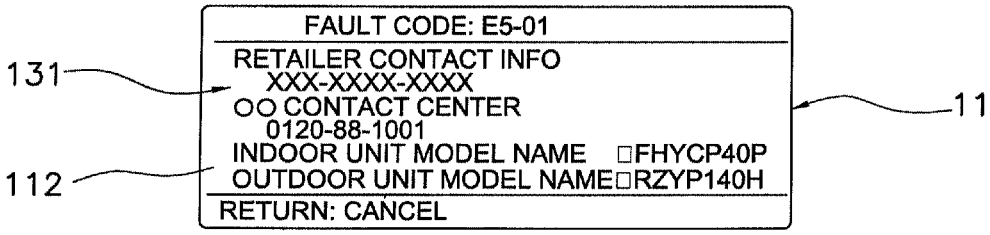

The remote control unit 10 displays a message on the display unit when a fault has occurred in the air conditioning apparatus 1. FIG. 3(*a*) is a front view of the remote control unit displaying a message. In FIG. 3(*a*), a message display column is set in the bottom section of the standard screen 110. Usually, nothing is displayed in the message display column, but when the controller 20 has received a fault occurrence notification signal input from the air conditioning apparatus 1 notifying that a fault has occurred, a fault message 31*a* reading "fault: please press menu" is displayed in the message display column. As a result, the user detects that a fault has occurred in the air conditioning apparatus 1 and presses the confirm button 15 where "menu" is printed.

When the confirm button 15 is pressed after the fault message 31*a* is displayed, the controller 20 changes the display unit 11 to the menu screen 111, and the menu 21 is displayed. FIG. 3(*b*) is a front view of the menu screen after the notification of the fault message. In FIG. 3(*b*), a fault response item 211 reading "service contact info/model name" is positioned at the head of the menu 21.

When the controller 20 receives an operation input from the confirm button 15 after receiving the fault occurrence notification signal input, the controller 20 places the fault response item 211 at the head of the menu 21 and moves the cursor 13 over the fault response item 211 so that the user can immediately find the fault response item 211. When the user presses the confirm button 15 again in this state, the display unit 11 changes to a fault response screen 112 for displaying fault response information 131. FIG. 3(*c*) is a front view of a fault response screen. In FIG. 3(*c*), the fault response information 131 includes information on whom to contact when a fault occurs, the model name of the air conditioning apparatus in which the fault occurred, and a fault code representing the specifics of the fault.

(Filter Cleaning Request Message)

Figure 4A:
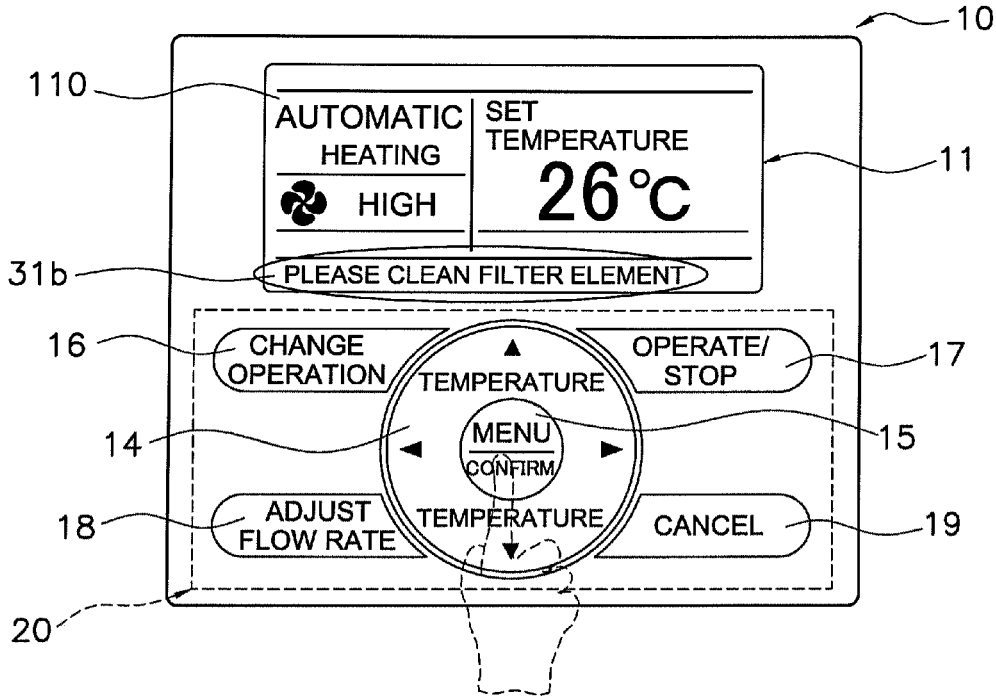
FIG. 4(*a*) is a front view of the remote control unit displaying a filter cleaning request message, and FIG. 4(*b*) is a front view of the remote control unit displaying the menu screen after the notification of the filter cleaning request message.
Figure 4B:
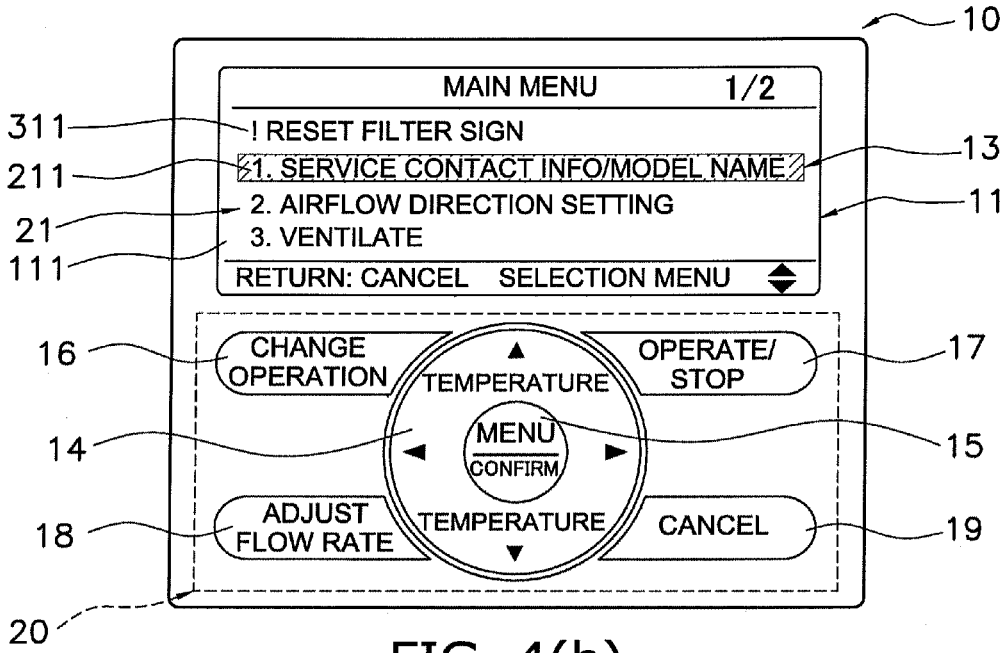

The messages are not limited to only times of faults in the air conditioning apparatus 1, and a message is also displayed when the filter becomes clogged. FIG. 4(*a*) is a front view of the remote control unit displaying a filter cleaning request message. When the controller 20 has received a filter maintenance request signal input from the air conditioning apparatus 1 notifying that the filter is clogged, a filter cleaning request message 31*b* reading "please clean the filter element" is displayed in the message display column. As a result, the user detects that the filter in the air conditioning apparatus 1 is clogged and presses the confirm button 15.

The controller 20 changes the display unit 11 to the menu screen 111 and displays the menu 21 when the confirm button 15 is pressed after the filter cleaning request message 31*b* is displayed. FIG. 4(*b*) is a front view of the remote control unit displaying the menu screen after the notification of the filter cleaning request message. In FIG. 4(*b*), a cancel command 311 reading "reset filter sign" and a fault response item 211 reading "service contact info/model name" are positioned at the top of the menu 21.

Since the air conditioning apparatus 1 can continue to operate even after the filter cleaning request message 31*b* has been displayed, the filter cleaning request message 31*b* remains continuously displayed. When the user wishes to delete the filter cleaning request message 31*b*, the user does so by selecting and executing the cancel command 311 reading "reset filter sign".

(Specific Item Read on Menu)

The items displayed on the menu 21 usually contain items that have no relation to the general user. For example, the owner of the air conditioning apparatus 1, such as a building manager, enables the low energy setting on the air conditioning apparatus 1 himself, but prefers that the building residents do not arbitrarily change the settings. In view of this, specific items not normally selected by the general user are usually not included on the initial menu 21 and are preferably only read on the menu 21 when needed by the owner.

Figure 5A:
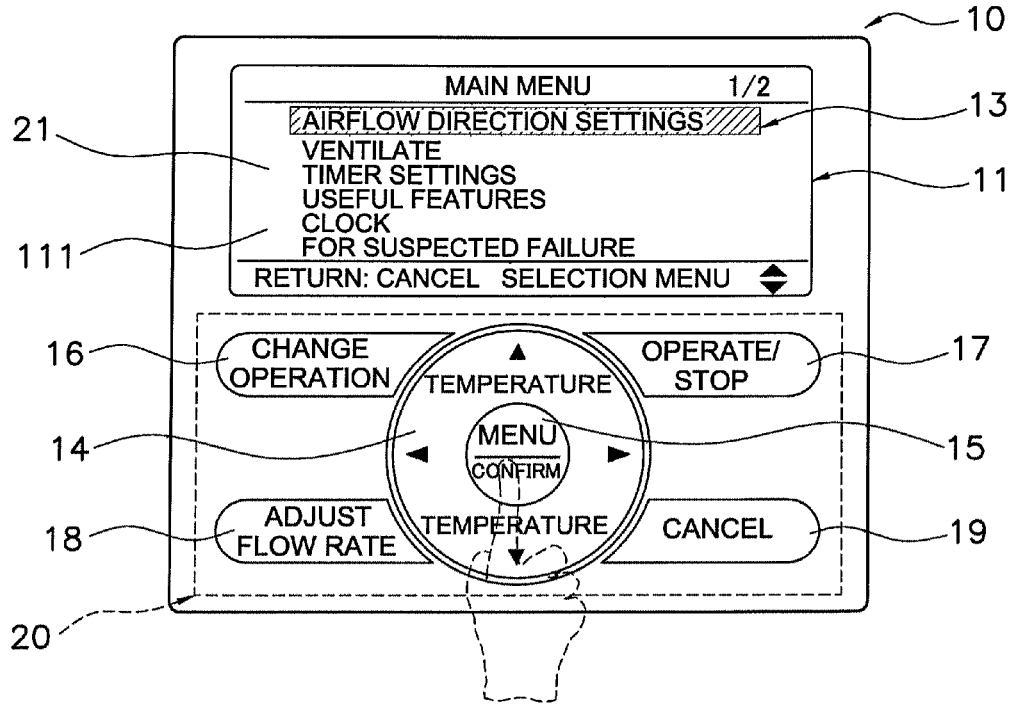
FIG. 5(*a*) is a front view of a remote control unit displaying the initial menu, and FIG. 5(*b*) is a front view of a remote control unit displaying a menu on which specific items are read.
Figure 5B:
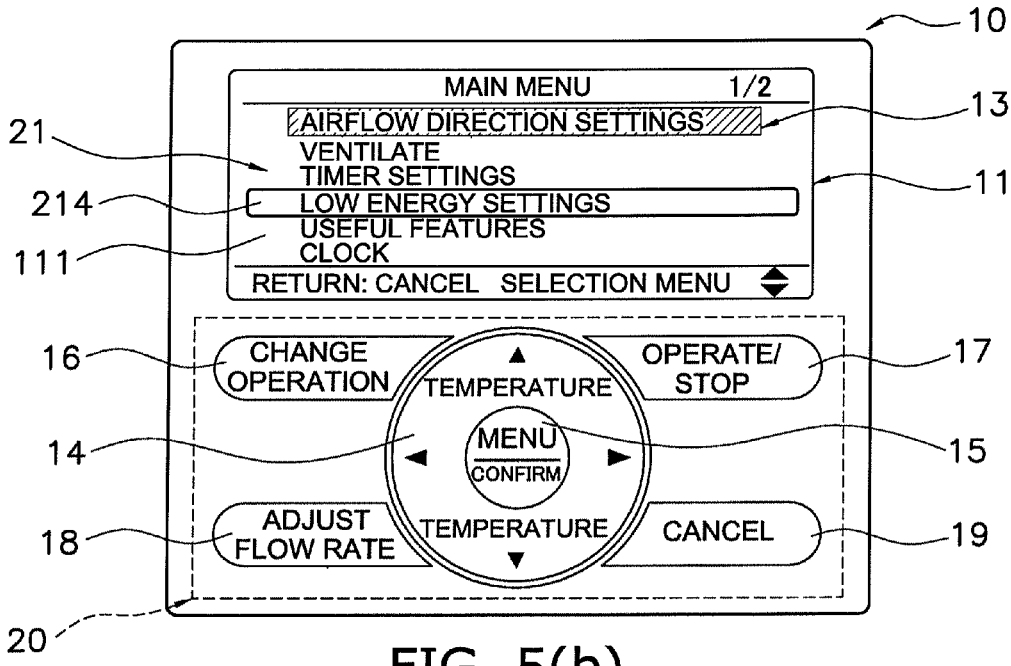

FIG. 5(*a*) is a front view of a remote control unit displaying the initial menu, and FIG. 5(*b*) is a front view of a remote control unit displaying a menu on which specific items are read. In FIG. 5(*a*), the initial menu 21 displays the airflow direction settings, ventilation, timer settings, useful features, clock, and other items usually set by the general user. When the confirm button 15 is held down while the cursor 13 is indicating the item "airflow direction settings" on the menu 21, the fourth item down from the top of the menu 21 is read, which is item 214, "low energy setting."

(Characteristics)

(1)

In the remote control unit 10, when the controller 20 has received from the air conditioning apparatus 1 either a fault notification signal input notifying of a fault or a filter maintenance request signal input requesting that the filter of the air conditioning apparatus 1 be cleaned, a fault response item 211 showing the locations of a plurality of information relevant to the fault needed by the user is positioned at the top of the menu 21. Since the user can immediately obtain the information needed for the fault, the user can deal with the fault quickly. Since the relevant information includes at least the fault specifics, contact information for the time the fault occurred, and the model name of the air conditioning apparatus in which the fault occurred, the user can find the contact information, model name, and other information without looking at the owner's manual, and the remote control unit is therefore easier to use.

(2)

In the remote control unit 10, when the controller 20 has put the display unit 11 in standby in the standard screen 110 and received a fault notification signal input, the controller 20 displays a fault message 31*a* on the standard screen, and when the confirm button 15 is operated once after the fault message 31*a* has been displayed, the controller 20 changes to the menu screen 111 that displays the menu 21. Since the fault message 31*a* warns the user, it is unlikely that inconvenient events and the like will go unattended. Operability is also improved because the user can see items pertaining to the fault message 31*a* merely by operating the confirm button 15 once.

(3)

In the remote control unit 10, when the controller 20 has put the display unit 11 in standby in the standard screen 110 and received a filter maintenance request signal input, the controller 20 displays a filter cleaning request message 31*b* on the standard screen, and when the confirm button 15 is operated once after the filter cleaning request message 31*b* has been displayed, the controller 20 changes to the menu screen 111 that displays the menu 21. A fault response item 211 and a cancel command 311 for releasing the display of the filter cleaning request message 31*b* are both positioned at the top of the menu 21. Usability is improved because in cases in which the user understands the specifics of the filter cleaning request message 31*b* and concludes that there is no need for the display, the user can release the display of the filter cleaning request message 31*b*.

(4)

When the controller 20 has received a prolonged time signal input for maintaining the same signal for a specified time duration, the remote control unit 10 reads specific items that have been stored in advance and positions the items at the top of the menu 21. Items common to all users can be included on the menu 21 from the beginning, and specific items needed for a specific user can be included on the menu 21 afterward. As a result, the items in the menu 21 are put in order, and a menu 21 which is easy to use can be created for the user. The input operation is simple because the prolonged time signal input is outputted when a single operation of the confirmation means is maintained for a specified time duration.

INDUSTRIAL APPLICABILITY

As described above, the remote control unit according to the present invention has a configuration which can be easily operated by a user and is therefore useful as a remote control unit for a multifunctional air conditioning apparatus.

What is claimed is:

1. A remote control unit for remotely operating an air conditioning apparatus, the remote control unit comprising:

a display unit configured to display a standard screen and a menu screen, the menu screen displaying a menu including a plurality of items and a cursor indicating an item among the plurality of items;

a cursor-moving member configured to move the cursor when operated by a user;

a confirmation member configured to decide that the item indicated by the cursor is to be executed in the menu screen; and a controller configured to control the display unit in response to the cursor-moving member or the confirmation member being operated, and configured to receive a notification/request signal input from the air conditioning apparatus requesting an operation via the confirmation member, and the controller being further configured to switch from the standard screen to the menu screen in response to confirmation member being operated in the standard screen, to display the plurality of items of the menu in a predetermined order on the menu screen with a first item of the plurality of items being positioned at a top of the menu when the confirmation member is operated in the standard screen and the notification/request signal has not been received, and to display a second item above the first item in the menu on the menu screen when the confirmation member is operated in the standard screen and the notification/request signal has been received, the second item corresponding to the notification/request signal and being different from the first item.

2. The remote control unit according to claim 1, wherein the controller is further configured to read a pre-stored specific item and to position the pre-stored specific item in the menu when a prolonged time signal input for a specified time duration is received by the controller.

3. The remote control unit according to claim 2, wherein the prolonged time signal input is outputted when a single operation of the confirmation member is maintained for the specified time duration.

4. A remote control unit for remotely operating an air conditioning apparatus, the remote control unit comprising:

a display unit configured to display a standard screen and a menu screen, the menu screen displaying a menu including a plurality of items and a cursor indicating an item among the plurality of items;

a cursor-moving member configured to move the cursor when operated by a user;

a confirmation member configured to decide that the item indicated by the cursor is to be executed in the menu screen; and a controller configured to control the display unit in response to the cursor-moving member or the confirmation member being operated, and configured to receive a notification/request signal input from the air conditioning apparatus requesting an operation via the confirmation member, the controller being further configured to switch from the standard screen to the menu screen in response to confirmation member being operated in the standard screen, to display the plurality of items of the menu in a redetermined order on the menu screen with a first item of the plurality of items being positioned at a top of the menu when the confirmation member is operated in the standard screen and the notification/request signal has not been received, and to display a second item above the first item in the menu on the menu screen when the confirmation member is operated in the standard screen and the notification/request signal has been received, the second item corresponding to the notification/request signal and being different from the first item, and the second item is a fault response item, with the fault response item showing locations of a plurality of relevant information items needed by the user when the notification/request signal input contains either a fault notification signal input notifying of a fault from the air conditioning apparatus or a filter maintenance request signal input requesting that a filter of the air conditioning apparatus be cleaned.

5. The remote control unit according to claim 4, wherein the relevant information items include at least fault specifics, contact information for the time the fault occurred, and model name of the air conditioning apparatus in which the fault occurred.

6. The remote control unit according to claim 4, wherein the controller is further configured to display only preset items different from the menu in the standard screen, and display a message on the standard screen upon receiving the fault notification signal input or the filter maintenance request signal input from the air conditioning apparatus.

7. The remote control unit according to claim 6, wherein the controller is further configured to position a cancel command at the top of the menu when the notification/request signal input contains the filter maintenance request signal input, with the cancel command being configured to cancel the display of the message and the fault response item.

* * * * *

UNITED STATES PATENT AND TRADEMARK OFFICE

CERTIFICATE OF CORRECTION

PATENT NO. : 8,689,140 B2
APPLICATION NO. : 12/525697
DATED : April 1, 2014
INVENTOR(S) : Kaya Horiuchi et al.

It is certified that error appears in the above-identified patent and that said Letters Patent is hereby corrected as shown below:

In The Claims

In Column 8, lines 56-57, Claim 4 change “rede-termined” to --predetermined--

Signed and Sealed this
Thirteenth Day of January, 2015

Michelle K. Lee

Michelle K. Lee
*Deputy Director of the United States Patent and Trademark Office*